US009863181B2

(12) United States Patent
Bourassa et al.

(10) Patent No.: US 9,863,181 B2
(45) Date of Patent: Jan. 9, 2018

(54) DOOR WITH HIGH ENERGY EFFICIENCY

(71) Applicant: Les Portes Alain Bourassa Inc., Terrebonne, Quebec (CA)

(72) Inventors: Mathieu Bourassa, Mascouche (CA); Alain Bourassa, Mascouche (CA)

(73) Assignee: LES PORTES ALAIN BOURASSA INC., Terrebonne (CA)

( * ) Notice: Subject to any disclaimer, the term of this patent is extended or adjusted under 35 U.S.C. 154(b) by 0 days.

(21) Appl. No.: 15/358,708

(22) Filed: Nov. 22, 2016

(65) Prior Publication Data

US 2017/0145735 A1 May 25, 2017

(30) Foreign Application Priority Data

Nov. 23, 2015 (CA) ..... 2913423

(51) Int. Cl.
*E06B 3/70* (2006.01)
*E06B 3/72* (2006.01)
*E06B 3/74* (2006.01)

(52) U.S. Cl.
CPC ..... *E06B 3/7015* (2013.01); *E06B 3/725* (2013.01); *E06B 3/74* (2013.01); *E06B 2003/7051* (2013.01); *E06B 2003/7063* (2013.01); *E06B 2003/7067* (2013.01)

(58) Field of Classification Search
CPC . E06B 3/10; E06B 3/70; E06B 3/7015; E06B 3/725; E06B 3/74; E06B 2003/7051; E06B 2003/7067; E06B 2003/7063
See application file for complete search history.

(56) References Cited

U.S. PATENT DOCUMENTS 3,286,424 A * 11/1966 Weyant ..... E04F 21/0007 49/501
4,281,479 A * 8/1981 Daus ..... E06B 3/827 49/503
4,341,831 A * 7/1982 Kleiss ..... C08J 5/124 156/313
5,791,047 A * 8/1998 Skalka ..... B29B 17/0042 29/525.12
5,848,505 A * 12/1998 Taylor ..... E06B 9/02 52/202
6,119,411 A * 9/2000 Mateu Gil ..... E04B 1/94 109/80

(Continued)

FOREIGN PATENT DOCUMENTS

CA 2836254 A1 * 6/2014 ..... E06B 5/11

*Primary Examiner* — Beth A Stephan
(74) *Attorney, Agent, or Firm* — Pierre Cantin; Brouillette Legal Inc.

(57) ABSTRACT

The invention relates to the manufacturing of solid wood doors and consists in increasing the insulating value of a door by inserting an insulating material between the internal and external panels and in the center of the structural parts of the door. In this way, a door with a minimum of non-insulated surfaces is achieved. By using this system, the insulating value of the assembled door is significantly increased and reach the requirements of high energy efficiency programs such as ENERGY STAR™. In addition to this, the rigidity and the durability of the solid wood door are not significantly compromised. A door with a traditional style and high thermal resistance levels is achieved.

18 Claims, 5 Drawing Sheets

(56) References Cited

U.S. PATENT DOCUMENTS 6,250,040 B1 * 6/2001 Green ..... E06B 3/72 52/455
6,434,899 B1 * 8/2002 Fortin ..... E06B 5/164 49/501
6,619,010 B2 * 9/2003 Wang Chen ..... E06B 3/825 49/501
6,643,991 B1 * 11/2003 Moyes ..... E06B 5/16 428/902
6,729,095 B2 * 5/2004 Wang Chen ..... E06B 3/5892 49/501
6,745,526 B1 * 6/2004 Autovino ..... E06B 3/74 52/232
8,286,399 B2 * 10/2012 Brown ..... E04B 1/14 52/404.4
9,482,044 B2 * 11/2016 Wong ..... E06B 5/113
2003/0208972 A1 * 11/2003 Reppermund ..... E06B 3/222 52/204.1
2004/0187428 A1 * 9/2004 Ballantyne ..... E06B 3/74 52/656.4
2005/0034397 A1 * 2/2005 Reppermund ..... E06B 3/222 52/455
2005/0115198 A1 * 6/2005 Lynch ..... E06B 3/7001 52/784.1
2008/0168744 A1 * 7/2008 Petersen ..... E06B 3/825 52/784.1
2008/0193771 A1 * 8/2008 Korsgaard ..... E04B 1/943 428/418
2010/0058705 A1 * 3/2010 Hanson ..... E06B 3/9649 52/656.4
2014/0053489 A1 * 2/2014 Bryant ..... E06B 3/72 52/456
2014/0165886 A1 * 6/2014 Yeremian ..... E06B 5/11 109/64

* cited by examiner

DOOR WITH HIGH ENERGY EFFICIENCY

CROSS-REFERENCE TO RELATED APPLICATIONS

The present patent application claims the benefits of priority of Canadian Patent Application No. 2,913,423, entitled "Porte à haute efficacité énergétique", and filed at the Canadian Patent Office on Nov. 23, 2015, the content of which is incorporated herein by reference.

FIELD OF THE INVENTION

The invention relates to the field of doors, in particular the manufacturing of solid wood slab doors.

BACKGROUND

Solid wood doors have been manufactured for many years with the same assembly principle.

In the last few years, the insulation of panels has become a standard step in the manufacturing of doors. The insulation of panels helps eliminate the problems of condensation on the interior of the panels, a location where the panels are the thinnest.

In construction, the R-value is the measurement of a material's capacity to resist heat flow from one side to the other. In simple terms, R-values measure the effectiveness of insulation and a higher number represents more effective insulation. Despite the insulation of panels, the global R value of a solid wood slab door remains relatively low.

In order to create a solid wood slab door with a higher R value, a system for insulating solid wood is herein provided.

OBJECTIVES OF THE INVENTION

The first objective of the invention is to have a solid wood slab door with a higher R value than the average solid wood slab door manufactured according to classical methods.

It is possible to increase the R value of the slab door by increasing its thickness; however, the R/inch value of the wood is around R-1/inch. Therefore, to reach a relatively high value, the thickness of the door is to be significantly increased, which can create structural and compatibility problems with hardware.

Another objective of the invention is to minimize the thickness of the door while significantly increasing the R value of the slab door.

It is preferable to keep the traditional aspects of the solid wood door such as mouldings, embossed panelling, curves and other architectural elements that are added to the style of the solid wood door.

We wish to create a concept allowing for increasing the R value of any door model such that new door models may also be created with a high R value.

The structural rigidity of the assembly is to remain uncompromised.

Since the dimension of a piece of wood varies in relation to several criteria, it is important that the insulation method does not constrain the wood and that it allows the wood the freedom to change in dimension.

SUMMARY OF THE INVENTION

The invention aims to increase the insulating factor of a solid wood door. Instead of increasing the thickness of the panels (There is one external panel and one internal panel, both of which are two distinct parts) or the rigid insulation between the two, we have discovered a new way to increase the insulating factor of the door's structure.

The invention is first directed to a solid door with high energy efficiency comprising:

- two vertical stiles defining the vertical edges of the door with a first stile comprising attaching elements for hingedly connecting the door to a door frame and a second stile, opposite to the first stile, optionally having a handle;
- a top and bottom horizontal rail connecting the two vertical stiles and defining the top and bottom edges of the door;
- the stiles and rails delimiting at least one panel of the door having an external and an interior surface; and
- at least one insulator member embedded within each stile and each panel.

According to a preferred embodiment, each insulator member is glued within the stiles and/or rails.

According to a preferred embodiment, a distance between an external surface of the door and any of said insulator member is inferior or equal to an inch.

According to a preferred embodiment, the insulator member comprises polyisocyanate, polystyrene or injected polyurethane.

According to a preferred embodiment, the at least one panel, the at least one stile, the at least one intermediary mullion and the at least one frame are made of wood.

According to a preferred embodiment, wherein an external and/or interior surface of the door is laminated with at least one lamination part.

According to a preferred embodiment, the insulator member is embedded between at least two separate parts affixed together to form said stile.

According to a preferred embodiment, the insulator member is embedded between at least two separate parts forming said panel.

According to a preferred embodiment, the door further comprises at least one intermediary mullion running the full height of the door; the intermediary mullion defining the vertical center of the door; wherein the stiles, rails and intermediary mullion delimiting said at least one panel of the door; the at least one insulator member being also embedded within each intermediary mullion.

According to a preferred embodiment, the insulator member is embedded between at least two separate parts affixed together to form said intermediary mullion, and wherein each insulator member is glued within the intermediary mullion.

The invention is also directed to a method for the making of a solid door with high energy efficiency properties. The door comprises at least two vertical stiles defining the vertical edges of the door with a first stile comprising attaching elements for hingedly connecting the door to a door frame and a second stile, opposite to the first stile, optionally having a handle; a top and bottom horizontal rail connecting the two vertical stiles and defining the top and bottom edges of the door; the stiles and rails delimiting at least one panel of the door having an external and an interior surface. The method comprising the steps of:

a) embedding at least one first insulator member within each stile;

b) embedding at least one second insulator member within each panel; and c) assembling the stiles, rails and panels to form the door.

According to a preferred embodiment, the method further comprises the steps of gluing the insulator member embedded within the stiles and/or panel.

According to a preferred embodiment, the door further comprises at least one intermediary mullion running the full height of the door; the intermediary mullion defining a vertical center of the door; wherein the stiles, rails and intermediary mullion delimiting said at least one panel of the door. The method then further comprises the steps of:

embedding at least one third insulator member within each intermediary mullion;

optionally gluing the insulator member embedded each intermediary mullion; and assembling the stiles, intermediary mullion, rails and panels to form the door.

According to a preferred embodiment, the insulator member is embedded between at least two separate parts attached together to form said intermediary mullion.

According to a preferred embodiment, the method further comprises the step of laminating an external and/or interior surface of the door.

According to a preferred embodiment, the lamination is performed by way of processing with the help of a profiler or a CNC.

According to a preferred embodiment, the insulator member is embedded between at least two separate parts attached together to form said stile.

According to a preferred embodiment, the insulator member is embedded between at least two separate parts attached together to form said panel.

According to a preferred embodiment, the insulator member is made by cutting from a rigid and raw piece comprising polyisocyanate, polystyrene or injected polyurethane.

According to a preferred embodiment, the manufacturing method of the at least one panel, stile and/or intermediary mullion is such that each is laminated with at least one piece of wood and processed with the help of a profiler or a CNC.

Since the structure of the door is composed of 100% solid wood, a method for increasing the insulating factor of the solid wood was needed. We therefore decided to introduce an insulating material at the center of the piece of wood.

The goal is to introduce insulating material with the highest R/inch value in order to minimize the thickness of the door and increase as much as possible the global R value of the door.

Since we wish to conserve an appropriate level of structural rigidity for each part and each door assembly, a type of sandwich manufacturing technique is plausible, but diminishes the rigidity of the whole since the link between the piece of wood on the outside and the one on the inside is the insulating material itself. Usually the insulating materials have a limited mechanical resistance. However, we have found a way to use the sandwich principle for small dimensional parts that do not have a heavy load.

In order to conserve the rigidity of the pieces, the insulation is to be inserted in the center of the part, but it is to be non-visible and the minimal size of the wall for the wood between the outside of any of the surface of the part and the insulation at the center is to be around half of the total thickness of the door minus the thickness of the insulation at the center.

In order to significantly grow the R value of the part of wood, the insulation is to be around ½ inch in thickness.

In order to minimize the chances of delamination, it is preferable to glue the insulation in the cavity.

Several manufacturing methods may achieve the desired result:

Create a cavity in a part, introduce the insulation and laminate the part over the cavity;

Create a part of 3 or more layers composed of at least one insulating layer and laminate one or more pieces of wood to hide the insulation;

Create a part of 3 or more layers composed of at least one insulating layer without laminating the sandwich assembly field (good for parts with small dimensions).

BRIEF DESCRIPTION OF THE FIGURES

The preceding description and other objectives, characteristics and advantages of the invention will be elucidated next in reference to the annexed figures in which.

DETAILED DESCRIPTION OF THE PREFERRED EMBODIMENTS

A new door with high energy efficiency is described below. Although the invention is described in relation to a specified embodiment, it is understood that this preferred embodiment serves only as an example and that the invention is not limited to the features of the embodiments described and illustrated herein, but includes all variations and modifications within the scope and spirit of the disclosure.

Figure 1:
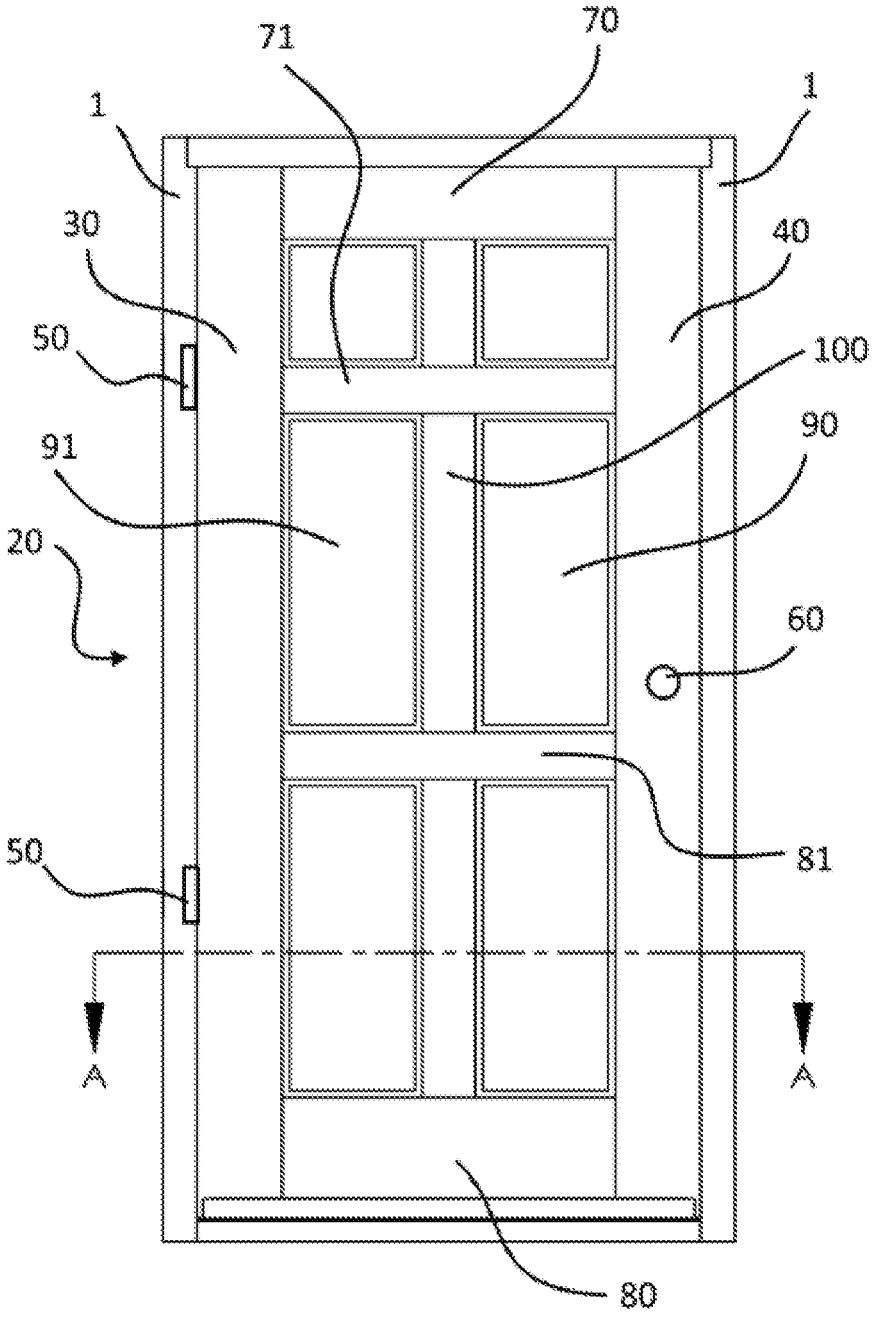
FIG. 1 is an elevated perspective of the assembly of the door in the preferred embodiment of the invention.
Figure 2:
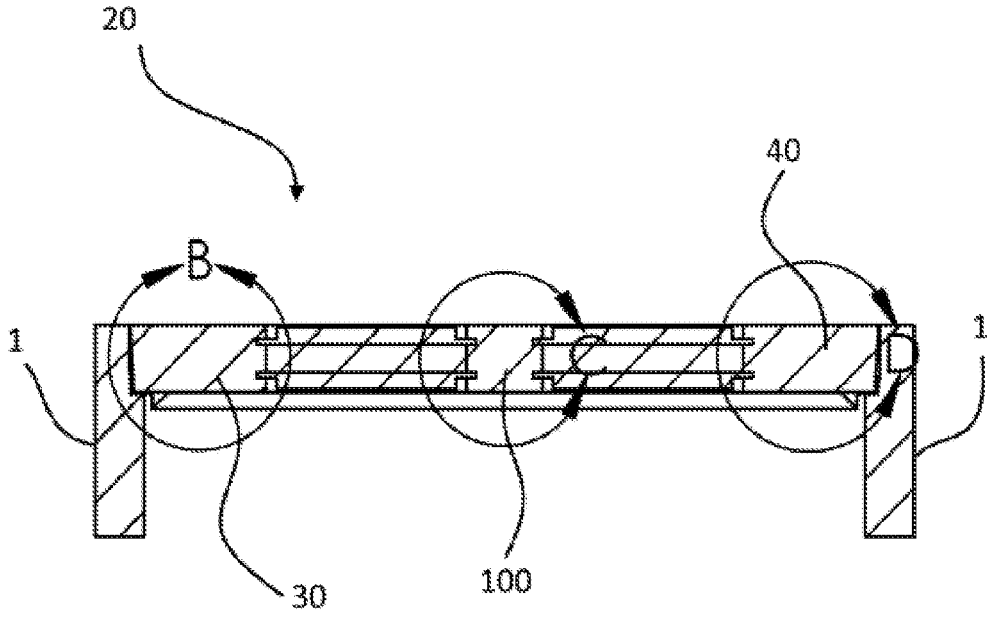
FIG. 2 is the cross-section AA presented in FIG. 1.

Referring to FIGS. 1 and 2, a door 20 comprises two vertical stiles 30, 40 and one intermediary mullion 100 running the full height of the door 20 and defining the vertical edges of the door 20 with a first stile 30 comprising attaching elements 50 for hingedly connecting the door 20 to a door frame 1 and a second stile 40, opposite to the first stile 30, optionally having a doorknob 60. A top and bottom horizontal rail 70, 80 connecting the two vertical stiles 30, 40 and defining the top and bottom edges of the door 20. The stile 40, the intermediary mullion 100 and rails 71, 81 delimiting a panel 90 of the door 20 having an external and an interior surface.

FIG. 1 shows the elevated perspective of the assembly of the door, where cross-section AA is further detailed in FIG. 2, which is comprised of the cross-section parts herein denoted as detail B, C and D.

Figure 3:
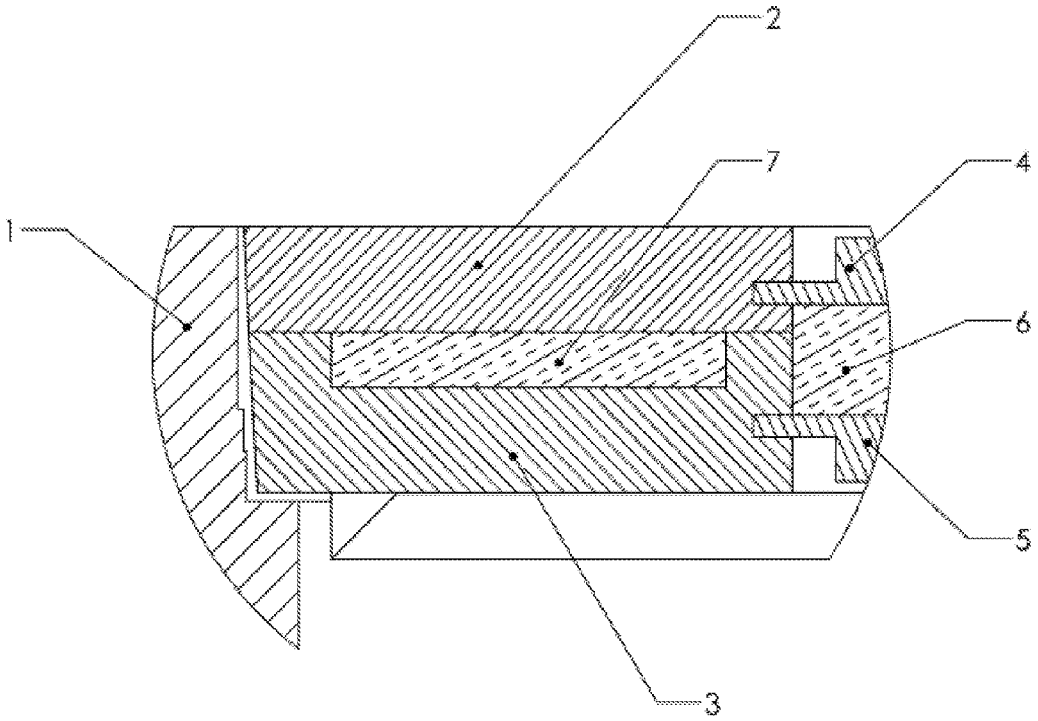
FIG. 3 shows detail B of the cross-section AA presented in FIG. 2.

Referring to FIG. 3 which shows detail B in FIG. 2, the manufacturing details of the frame 1, stile 30 and panel 91 on the side of the door hinge elements 50 are shown. This stile 30 and panel 91 section is manufactured with many parts and many materials contrary to a traditional stile and panel that are simply composed of one or several pieces of wood laminated in a single operation. The composite parts of the door 20 on the side of the door hinge elements 50 are enumerated in the table below:

| Part | Description |
|---|---|
| 1 | Door frame;<br>Material type: wood<br>Alternative material: none |

-continued

| Part | Description |
|---|---|
| | Manufacturing method: Part laminated with several pieces of wood and processed with the help of a profiler or a CNC. |
| 2 | Internal portion of the stile;<br>Material type: wood<br>Alternative material: none<br>Manufacturing method: Part laminated with several pieces of wood and processed with the help of a profiler or a CNC. |
| 3 | External portion of the stile;<br>Material type: wood<br>Alternative material: none<br>Manufacturing method: Part laminated with several pieces of wood and processed with the help of a profiler or a CNC |
| 4 | Internal panel;<br>Material type: wood<br>Alternative material: none<br>Manufacturing method: Part laminated with several pieces of wood and processed with the help of a profiler or a CNC. |
| 5 | External panel;<br>Material type: wood<br>Alternative material: none<br>Manufacturing method: Part laminated with several pieces of wood and processed with the help of a profiler or a CNC. |
| 6 | Panel insulation;<br>Material type: Polyisocyanate<br>Alternative material: Polystyrene, injected polyurethane or other rigid insulation materials.<br>Manufacturing method: Part cut from a rigid, crude piece. |
| 7 | Stile insulation;<br>Material type: Polyisocyanate<br>Alternative material: Polystyrene, injected polyurethane or other rigid insulation materials.<br>Manufacturing method: Part cut from a rigid, crude piece. |

These parts are principally the external part of the stile (part 3), the stile's insulation (part 7), the internal part of the stile (part 2), the panels (parts 4 and 5) and the panel insulation (part 6).

Global R values achieved with different door types are tabulated herein:

| R value | Thickness | Insulation location | Door type |
|---|---|---|---|
| ≈R-2 | 2¼" | None | Other |
| ≈R-2,5 | 2¼" | Between panels | Other |
| ≈R-7 | 3" | In frame and between panels | Current invention |

The doors according to the present invention provide a R-value of about R-7 which is 2.8 times higher that a similar door with insulation between the panels only, or 3.5 times higher than a door without insulation.

Figure 4:
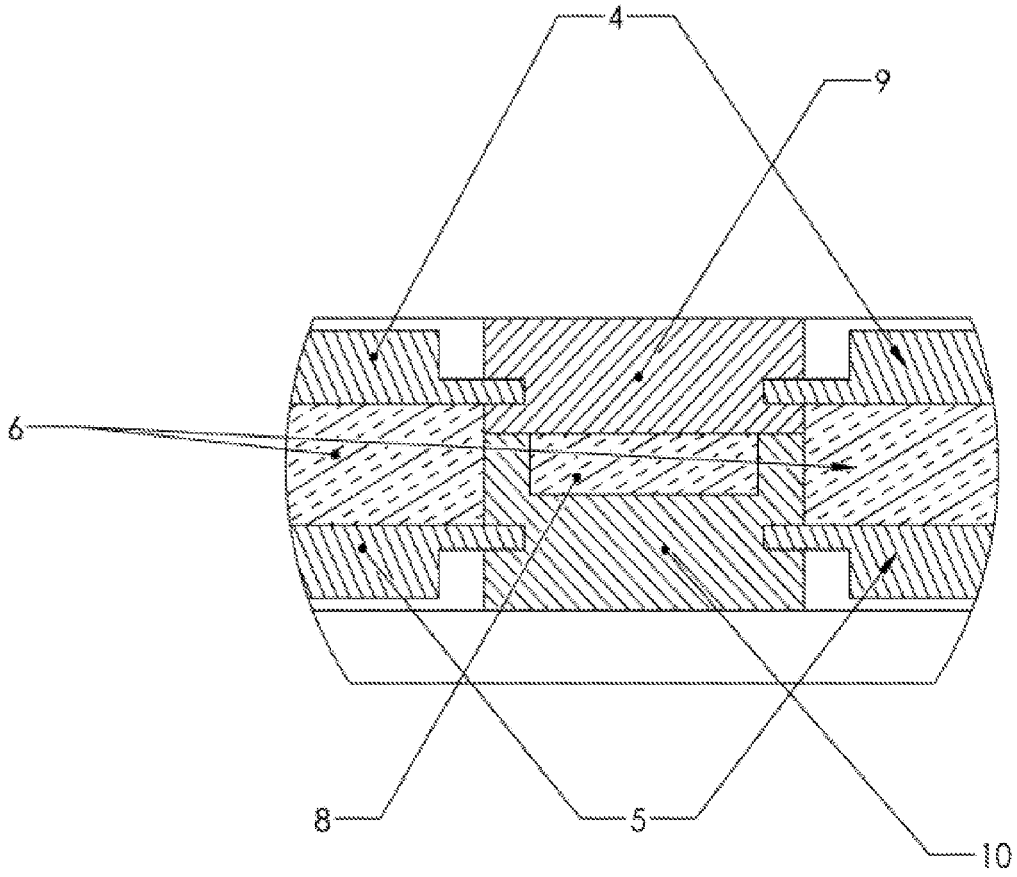
FIG. 4 shows detail C of the cross-section AA presented in FIG. 2.

Referring to FIG. 4 showing detail C in FIG. 2, the detail of the manufacturing of the intermediary section of the door 20 with an intermediary mullion 100 is shown. This intermediary section of the door 20 with an intermediary mullion 100 is manufactured from several parts and several materials contrary to the traditional door part that is composed of one or more pieces of wood laminated in a single operation. The composite parts of the intermediary section of the door 20 with the intermediary mullion 100 are enumerated in the table below:

| Part | Description |
|---|---|
| 9 | Internal intermediary mullion;<br>Material type: wood<br>Alternative material: none<br>Manufacturing method: Part laminated with several pieces of wood and processed with the help of a profiler or a CNC. |

-continued

| Part | Description |
|---|---|
| 10 | External intermediary mullion;<br>Material type: wood<br>Alternative material: none<br>Manufacturing method: Part laminated with several parts of wood and processed with the help of a profiler or a CNC. |
| 4 | Internal panels;<br>Material type: wood<br>Alternative material: none<br>Manufacturing method: Part laminated with several pieces of wood and processed with the help of a profiler or a CNC. |
| 5 | External panels;<br>Material type: wood<br>Alternative material: none<br>Manufacturing method: Part laminated with several pieces of wood and processed with the help of a profiler or a CNC. |
| 6 | Panel insulation;<br>Material type: Polyisocyanate<br>Alternative material: Polystyrene, injected polyurethane or other rigid insulation materials.<br>Manufacturing method: Part cut from a rigid, crude piece. |
| 8 | Intermediary mullion insulation;<br>Material type: Polyisocyanate<br>Alternative material: Polystyrene, injected polyurethane or other rigid insulation materials.<br>Manufacturing method: Part cut from a rigid, raw piece. |

These parts are principally the external part of the intermediary mullion (part 10), the mullion insulation (part 8), the internal part of the intermediary mullion (part 9), the panels (part 4 and 5) and the panel insulations (part 6).

Figure 5:
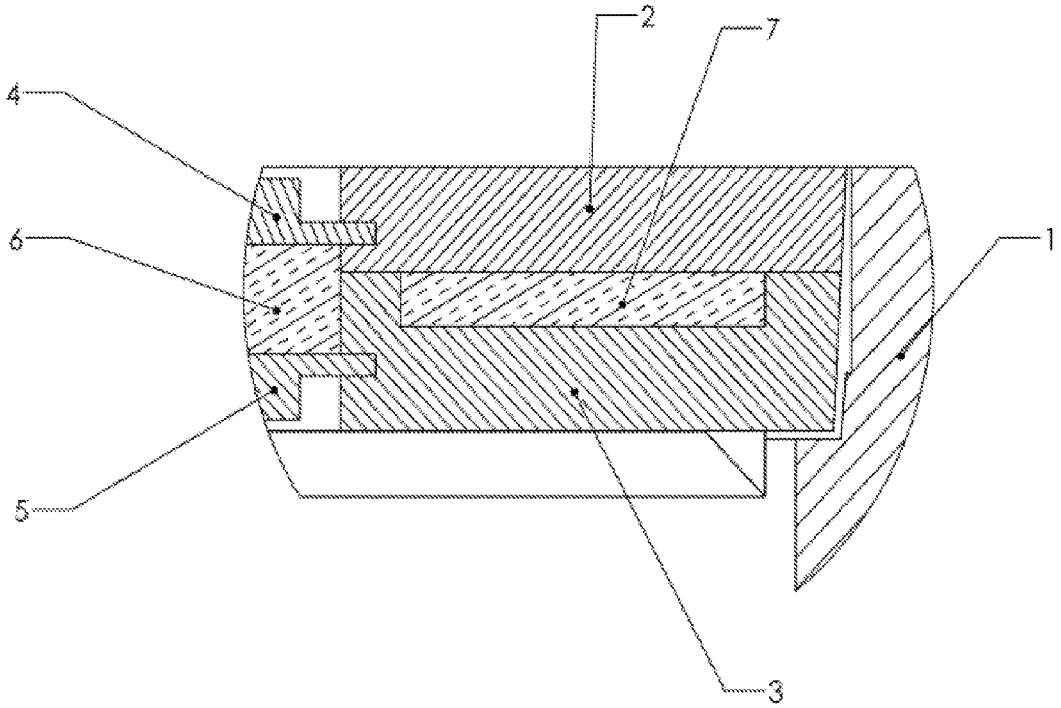
FIG. 5 shows detail D of the cross-section AA presented in FIG. 2.

Referring to FIG. 5 showing detail D in FIG. 2, the manufacturing details of the the frame 1, stile 40 and panel 90 on the side of the door knob 60 are shown. This stile 40 and panel 90 section is manufactured with several parts and several materials, contrary to a traditional stile and panel that are simply composed of one or several pieces of wood laminated in a single operation. The composite parts of the door 20 on the side of the door knob 60 are enumerated in the table below:

| Part | Description |
|---|---|
| 1 | Door frame;<br>Material type: wood<br>Alternative material: none<br>Manufacturing method: Part laminated with several pieces of wood and processed with the help of a profiler or a CNC. |
| 2 | Internal portion of the stile;<br>Material type: wood<br>Alternative material: none<br>Manufacturing method: Part laminated with several pieces of wood and processed with a CNC. |
| 3 | External portion of the stile;<br>Material type: wood<br>Alternative material: none<br>Manufacturing method: Part laminated with several pieces of wood and processed with a CNC. |
| 4 | Internal panel;<br>Material type: wood<br>Alternative material: none<br>Manufacturing method: Part laminated with several pieces of wood and processed with the help of a profiler or a CNC. |
| 5 | External panel;<br>Material type: wood<br>Alternative material: none<br>Manufacturing method: Part laminated with several pieces of wood and processed with the help of a profiler or a CNC. |
| 6 | Panel insulation;<br>Material type: Polyisocyanate<br>Alternative material: Polystyrene, injected polyurethane or other rigid insulation materials.<br>Manufacturing method: Part cut from a rigid, crude piece. |

-continued

| Part | Description |
|---|---|
| 7 | Stile insulation;<br>Material type: Polyisocyanate<br>Alternative material: Polystyrene, injected polyurethane or other rigid insulation materials.<br>Manufacturing method: Part cut from a rigid, raw piece. |

These parts are primarily the external part of the stile (part 3), the stile insulation (part 7), the internal part of the stile (part 2), the panels (parts 4 and 5) and the panel insulation (part 6).

Although the illustrated preferred embodiment of the invention has been described below, it is understood that the concepts of the invention may be incorporated and used in other embodiments and that the annexed claims are to be interpreted to include other embodiments, with the exception of any that are limited by the prior art.

The invention claimed is:

1. A door comprising:

a first and second vertical stile defining vertical edges of the door with the first stile comprising attaching elements for hingedly connecting the door to a door frame;

a top and bottom horizontal rail connecting the two vertical stiles and defining a top and bottom edge of the door;

the stiles and rails delimiting at least one panel of the door having an external and an interior surface; and at least one insulator member embedded between at least two separate parts affixed together to form each of the stiles and the at least one panel.

2. The door of claim 1, wherein the at least one insulator member is glued within the stiles and the rails.

3. The door of claim 1, wherein a distance between an external surface of the door and the at least one insulator member is less than or equal to a total thickness of the door minus a thickness of the at least one insulator member divided by two.

4. The door of claim 1, wherein the at least one insulator member is made of polyisocyanate, polystyrene or polyurethane.

5. The door of claim 1, wherein the at least one panel, the stiles, and the at least one frame are made of wood, the door having an R-value of about R-7.

6. The door of claim 1, wherein an external or interior surface of the door is laminated with at least one lamination part.

7. The door of claim 1, further comprising at least one intermediary mullion running a full height of the door; the at least one intermediary mullion defining a vertical center of the door; wherein the stiles, rails and the at least one intermediary mullion delimiting said at least one panel of the door; the at least one insulator member being also embedded within the at least one intermediary mullion.

8. The door of claim 7, wherein the at least one insulator member is embedded between at least two separate parts affixed together to form the at least one intermediary mullion, and wherein the at least one insulator member is glued within the at least one intermediary mullion.

9. A method for making a door, the door comprising at least two vertical stiles defining vertical edges of the door with a first stile comprising attaching elements for hingedly connecting the door to a door frame and a second stile, opposite to the first stile; a top and bottom horizontal rail connecting the two vertical stiles and defining a top and a bottom edge of the door; the stiles and the rails delimiting at least one panel of the door having an external and an interior surface;

the method comprising the steps of:

a) embedding at least one first insulator member between at least two separate parts affixed together to form each of the stiles;

b) embedding at least one second insulator member between at least two separate parts affixed together to form the at least one panel; and c) assembling the stiles, the rails and the at least one panel to form the door.

10. The method of claim 9, wherein the insulator members are made from injected polyurethane.

11. The method of claim 9, wherein the insulator members are made by cutting from a piece comprising polyisocyanate or polystyrene.

12. The method of claim 9, further comprising the steps of gluing the insulator members embedded within the stiles and the at least one panel.

13. The method of claim 9, wherein the door further comprises at least one intermediary mullion running a full height of the door; the at least one intermediary mullion defining a vertical center of the door; wherein the stiles, the rails and the at least one intermediary mullion delimiting said at least one panel of the door; the method further comprising the steps of:

embedding at least one third insulator member within the at least one intermediary mullion;

optionally gluing the insulator members embedded within the at least one intermediary mullion; and assembling the stiles, the at least one intermediary mullion, rails and the at least one panel to form the door.

14. The method of claim 13, wherein one of the insulator members is embedded between at least two separate parts attached together to form the at least one intermediary mullion.

15. The method of claim 9, further comprising the step of laminating an external or interior surface of the door.

16. The method of claim 15, wherein the step of laminating is performed by a profiler or a CNC.

17. The method of claim 9, wherein the at least one first insulator member is embedded between at least two separate parts attached together.

18. The method of claim 9, wherein the at least one second insulator member is embedded between at least two separate parts attached together.

* * * * *